US007207806B2

(12) United States Patent
Higgins

(10) Patent No.: US 7,207,806 B2
(45) Date of Patent: Apr. 24, 2007

(54) LOW COST COAXIAL CABLE CONNECTION FOR WIRELESS ANTENNAS

(75) Inventor: William B. Higgins, Silverado, CA (US)

(73) Assignee: Broadcom Corporation, Irvine, CA (US)

( * ) Notice: Subject to any disclaimer, the term of this patent is extended or adjusted under 35 U.S.C. 154(b) by 26 days.

(21) Appl. No.: 11/117,515

(22) Filed: Apr. 29, 2005
(Under 37 CFR 1.47)

(65) Prior Publication Data

US 2006/0030209 A1 Feb. 9, 2006

Related U.S. Application Data

(60) Provisional application No. 60/599,045, filed on Aug. 6, 2004.

(51) Int. Cl.
*H01R 9/05* (2006.01)

(52) U.S. Cl. ..... 439/63; 439/581

(58) Field of Classification Search ..... 439/578, 439/63, 579–585, 885; 174/74 R
See application file for complete search history.

(56) References Cited

U.S. PATENT DOCUMENTS 5,041,013 A * 8/1991 Greenbaum ..... 439/425
5,314,349 A * 5/1994 Czeschka et al. ..... 439/394
6,372,990 B1 * 4/2002 Saito et al. ..... 174/74 R
6,824,392 B1 * 11/2004 Guo ..... 439/63

* cited by examiner

*Primary Examiner*—Alexander Gilman
(74) *Attorney, Agent, or Firm*—Squire, Sanders & Dempsey L.L.P.

(57) ABSTRACT

A connection assembly provides an electrical connection from a coaxial cable to planar circuitry. The connection assembly includes an innermost connector node, configured to connect electrically to an innermost conductor of a coaxial cable, having one opening that allows for the innermost conductor to pass through the one opening and having a first contact extending perpendicular to a center line of the coaxial cable, a braided connector node, configured to connect electrically to a braided conductor of the coaxial cable, having two openings that allow for portions of the coaxial cable to pass through the two openings and having a second contact extending perpendicular to the center line of the coaxial cable and a connection module, connected to the innermost connector node and the braided connector node and configured to maintain an orientation of the innermost and braided connector nodes and the first and second contacts. The first and second contacts can be connected to separate locations of a planar circuitry and provide separate electrical connections to the innermost conductor and the braided conductor of the coaxial cable.

27 Claims, 4 Drawing Sheets

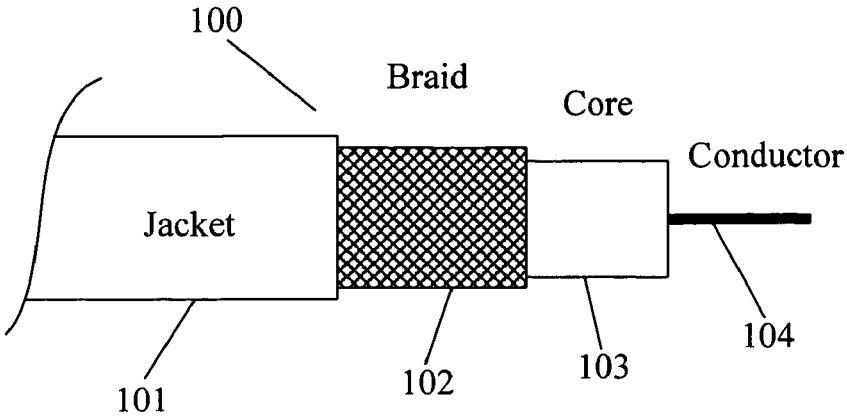
Fig. 1
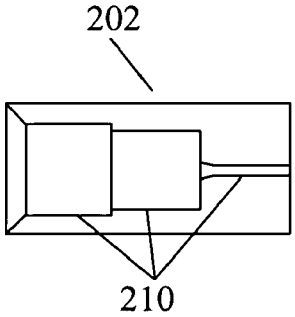
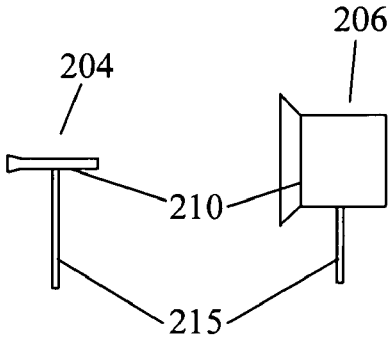
Fig. 2(a) Fig. 2(b) Fig. 2(c)
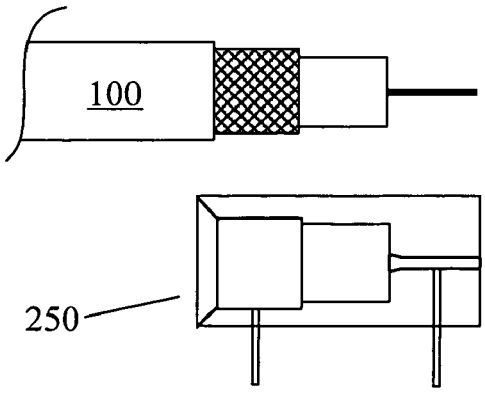
Fig. 2(d)

LOW COST COAXIAL CABLE CONNECTION FOR WIRELESS ANTENNAS

CROSS-REFERENCE TO RELATED APPLICATIONS

This application claims priority to U.S. Provisional Patent Application Ser. No. 60/599,045, filed Aug. 6, 2004, the entire contents of which are incorporated herein by reference.

BACKGROUND OF THE INVENTION

1. Field of the Invention

The present invention relates to apparatuses and methods for providing connections from cabling to circuit board assemblies. In particular, the present invention is directed to means for creating electrical and physical connections of coaxial cables to circuitry for use with wireless antennas.

2. Description of Related Art

Traditionally, in computer networking, computers and other devices in a network were connected through wired connections. Wireless networking had not previously been widely adopted due to the low data rates supported and the lack of an international standard. The development of specific standards for high-speed wireless networking has allowed for more ubiquitous networking. Thus, local area networks employing wireless devices are becoming more common and many different types of devices require antenna connections to allow for wireless communication.

Exemplars of those wireless networking technologies are IEEE 802.11(a), 802.11(b), 802.11(g) and BLUETOOTH, easy personal wireless connectivity methodologies. All of these specifications require antenna assemblies that allow the mobile devices to communicate using electromagnetic signals, with both established wireless networks and, in ad hoc networks, with each other.

As the use of wireless networks become more widespread, a greater number of devices, as well as types of devices, may employ wireless communication. For example, heretofore un-networked devices, like a digital picture frame, may connect with wireless networks to update data, such as updating a digital photo displayed in the frame. As the networks become more ubiquitous, the need for cheaper and simpler connection of antenna to the circuitry of the devices becomes more acute.

Currently, on wireless designs, an antenna connects to broadcast and reception circuitry through a cable with connectors at at least one end. These connectors are often very expensive and can increase the overall cost of a device. While the cost of the connector may be a small percentage of the overall cost of the device, the cost may still decrease a profit margin for a device. Lower cost designs have often soldered the coax wire directly to the printed circuit board (PCB), and this is prone to many problems, such as the wire withdrawing from the PCB holes, where the cable is connected. Additionally, the heat of soldering can melt insulation, and change the electrical properties of the connection.

Thus, there is a need in the prior art for a connector that will maintain the concentricity of the coax cable while the cable is affixed to the PCB, as well as maintain electrical characteristics of the connection. There is also a need for a connector that will speed assembly time by making the antenna wire stay in the PCB during soldering. There is also a need for a connector that will reduce the overall cost for the connection while maintaining efficiency and quality of the connection.

SUMMARY OF THE INVENTION

According to one embodiment of the invention, a connection assembly provides an electrical connection from a coaxial cable to planar circuitry. The connection assembly includes an innermost connector node, configured to connect electrically to an innermost conductor of a coaxial cable, having one opening that allows for the innermost conductor to pass through the one opening and having a first contact extending perpendicular to a center line of the coaxial cable, a braided connector node, configured to connect electrically to a braided conductor of the coaxial cable, having two openings that allow for portions of the coaxial cable to pass through the two openings and having a second contact extending perpendicular to the center line of the coaxial cable and a connection module, connected to the innermost connector node and the braided connector node and configured to maintain an orientation of the innermost and braided connector nodes and the first and second contacts. The first and second contacts can be connected to separate locations of a planar circuitry and provide separate electrical connections to the innermost conductor and the braided conductor of the coaxial cable.

Additionally, the planar circuitry may be a circuitry on a printed circuit board and the first and second contacts may be configured to be soldered to sections on the printed circuit board. Also, the circuitry on a printed circuit board may provide for wireless networking and the coaxial cable may provide an antenna for wireless networking. In addition, at least one of the first and second contacts may have a retention end that retains the retention end after the retention end has passed through a through-hole in the printed circuit board.

In addition, the innermost connector node and the braided connector node may be configured to make contact with conductors of a prepared coaxial cable, where the prepared coaxial cable has portions of the coaxial cable stripped away to leave predetermined sections of the innermost conductor and the braided conductor bare. Alternatively, the innermost connector node and the braided connector node may be configured to make contact with conductors of an un-prepared coaxial cable, where the un-prepared coaxial cable has a cleaved end and the innermost connector node and the braided connector node are inserted into the cleaved end to make the physical and electrical connections.

Also, the one opening and at least one of the two openings may have fluted sections to assist in entry of respective portions of the coaxial cable. The connection module may be formed from a non-conducting material and may have cavities that are configured to receive the innermost connector node and the braided connector node. The connection module may be a breakaway tab with small breakaway connections to the innermost connector node and the braided connector node, wherein the breakaway tab is configured to be removed subsequent to connections being made between the coaxial cable and the innermost connector node and the braided connector node.

The innermost connector node, the braided connector node and the connection module may be formed from a single sheet of sheet metal. The innermost connector node may be a single spike connected to the first contact, wherein the spike is configured to be inserted into the coaxial cable and make contact with the innermost conductor. Also, the braided connector node may be a barrel connection connected to the second contact, wherein the barrel connection is configured to be inserted into the coaxial cable and make contact with the braided conductor. The barrel connection may have a sharpened edge that aides in inserting the barrel connection between an outer jacket and an inner core of the coaxial cable or multiple tines having sharpened edges that aides in inserting the barrel connection between an outer jacket and an inner core of the coaxial cable. Additionally, the barrel connection may include retention barbs that make contact with an inner portion of the outer jacket and aides in retaining the barrel connection after insertion of the barrel connection between the outer jacket and the inner core of the coaxial cable.

According to another embodiment, a tool for assisting in providing an electrical connection from a coaxial cable to planar circuitry through a connection assembly is disclosed. The tool includes a handle, configured to be held and manipulated manually and a holder, configured to receive the connection assembly and configured to receive portions of the coaxial cable into the connection assembly.

According to another embodiment, a connection assembly for providing an electrical connection from a coaxial cable to planar circuitry is disclosed. The connection assembly includes an innermost connector means for connecting electrically and physically to an innermost conductor of a coaxial cable, having one opening that allows for the innermost conductor to pass through the one opening and having a first contact extending perpendicular to a center line of the coaxial cable, a braided connector means for connecting electrically and physically to a braided conductor of the coaxial cable, having two openings that allow for portions of the coaxial cable to pass through the two openings and having a second contact extending perpendicular to the center line of the coaxial cable and a connection module means for connecting the innermost connector means and the braided connector means and configured to maintain an orientation of the innermost and braided connector means and the first and second contacts. The first and second contacts can be connected to separate locations of a planar circuitry and provide separate electrical connections to the innermost conductor and the braided conductor of the coaxial cable.

According to another embodiment, a method for providing an electrical connection from a coaxial cable to planar circuitry is disclosed. The method includes the steps of providing a connection assembly having an innermost connector node, having one opening that allows for an innermost conductor of a coaxial cable to pass through the one opening and having a first contact extending perpendicular to a center line of the coaxial cable, a braided connector node, having two openings that allow for portions of the coaxial cable to pass through the two openings and having a second contact extending perpendicular to the center line of the coaxial cable and a connection module, connected to the innermost connector node and the braided connector node, inserting the coaxial cable into the connection assembly to connect the innermost connector node electrically and physically to the innermost conductor and to connect the braided connector node electrically and physically to a braided conductor of the coaxial cable and connecting the first and second contacts to separate locations of a planar circuitry, providing separate electrical connections to the innermost conductor and the braided conductor of the coaxial cable.

These and other variations of the present invention will be described in or be apparent from the following description of the preferred embodiments.

BRIEF DESCRIPTION OF THE DRAWINGS

For the present invention to be easily understood and readily practiced, the present invention will now be described, for purposes of illustration and not limitation, in conjunction with the following figures:

FIG. 1 illustrates a schematic of a coaxial cable showing the layers that make up the cable;

FIG. 2 illustrates an assembly to provide a connection between a coaxial cable and circuitry, according to one embodiment of the present invention. FIGS. 2(*a*) through 2(*c*) illustrate the constituent parts of the assembly and FIG. 2(*d*) illustrates the combined assembly prior to attachment with a prepared coaxial cable;

FIG. 3(*a*) provides another embodiment of the connection assembly, with FIG. 3(*b*) showing the connection assembly attached to a prepared coaxial cable and FIG. 3(*c*) showing the removal of an assembly tab;

DETAILED DESCRIPTION OF PREFERRED EMBODIMENTS

Figure 3A:
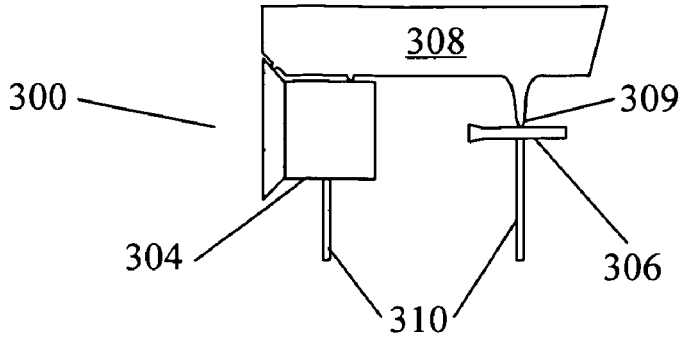
FIG. 3 provides one embodiment of the present invention and a method of making the required connection using that embodiment.

The present invention allows for proper connection of a coaxial cable to circuitry. The present invention allows for the concentricity of the coaxial cable connections to be maintained while the cable is affixed to a PCB, thus maintaining electrical characteristics of the connection. The present invention will also speed assembly time by making the antenna wire, formed from the coaxial cable, stay in the PCB during soldering. While the instant invention's connections are not as inexpensive as un-terminated wire, the minor costs are recouped through improved assembly throughput and reduction in errors.

The connection assemblies of the present invention can, in many embodiments, be formed by a low cost sheet metal stamping. The connection assemblies can be formed to mate with the end of the coaxial cable, either stripped or unstripped, and mate with a PCB with or without retention type contacts. In the various embodiments, the connections can be manufactured for less than US$0.01, while a typical PCB connector is US $0.25 to US $0.50, and another connector would be required on the antenna end to mate with it. (All dollars amounts in U.S. dollars, circa 2004).

The structure of a coaxial cable is illustrated in FIG. 1. The coaxial cable 100 has an outer jacket 101 that covers the underlying layers and acts to protect those underlying layers. Immediately under the jacket layer 101 is a braided conductor layer 102 and can act as a shielding layer for signals traveling on the innermost conductor 104. The innermost conductor 104 is separated from the braided conductor 102 by a core layer 103, that electrically insulates the innermost and braided conductors. If the coaxial cable is "unprepared," then the cable is cut so that each layer is accessible only through a cut end. If the cable is prepared, such as illustrated in FIG. 1, it has the layers stripped away in a stepped fashion, such that each layer is accessible laterally along the length of the cable.

One embodiment of the connection assembly of the present invention is illustrated in FIG. 2. FIG. 2(*a*) illustrates the insulator body portion 202 of the connection assembly. That portion has cavity sections 210 that allow for other portions to be inserted. FIG. 2(*b*) illustrates a center connector node 204, having cavity section 210 that is constructed to receive the innermost conductor 104. The receiving end of the cavity section is fluted to facilitate the entry of the innermost conductor. The center connector node has a contact 215 that is electrically connected to the innermost conductor once it is introduced into the cavity.

FIG. 2(*c*) illustrates the braid node 206 that has a similar structure as that of the center connector node. The braid node has a cavity 210 that is constructed to receive the stripped, braided portion of the prepared cable. The braid node also has a contact 215 that is electrically connected to the braided portion once it is introduced into the cavity. Like the other node, the braid node has a fluted end of the cavity to facilitate entry of the braided portion.

For proper connection to the prepared cable, the nodes 204 and 206 are inserted into cavities in the insulator body portion 202, as illustrated in FIG. 2(*d*). Thereafter, the prepared cable is inserted into the nodes and portion. The braided portion makes an electrically connection with one of the contacts and the innermost conductor makes an electrically connection with the other of the contacts. The cable with the connection assembly can then be brought to the circuitry, such as a PCB, where the contacts 215 are used to make an electrical connection between the circuitry and the cable. Connection assembly facilitates this connection by having, for example, the contacts pass through holes in the PCB and then soldered to contact lines on the PCB.

It should be noted that the connection assembly illustrated in FIG. 2 is but one embodiment of the present invention. In one embodiment, both nodes, 204 and 206, may be formed from sheet metal through a stamping process. The stamped shapes would be bent to form the shapes necessary to receive and connect to the innermost conductor and the braided conductor. The choice of the metal used for the nodes may be based on cost and ability to form a conductive connection.

Figure 3B:
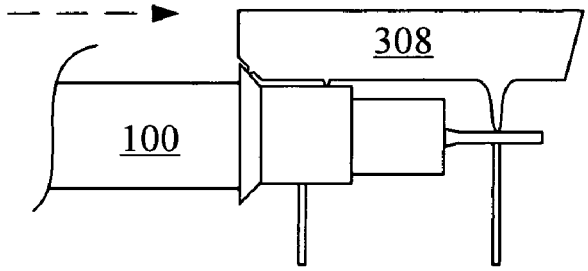
Figure 3C:
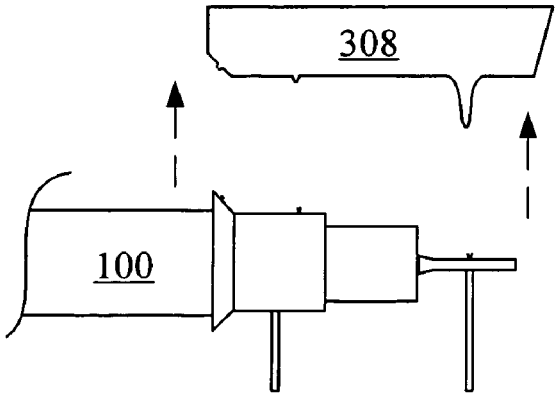

Additionally, as illustrated in FIG. 3, the nodes may be formed from a single sheet or separately formed and attached to a common tab 308. The connection assembly 300 has two nodes 304 and 306, illustrated in FIG. 3(*a*), similar in form and function to that illustrated in FIG. 2. Each node has a contact 310 that mates with a hole in a PCB used to receive that contact. The nodes 304 and 306 are attached to the breakaway tab 308 through "mouse-bites" or thin breakaway connections 309. The number of breakaway connections is variable, depending on the material used to form the nodes and breakaway tab and how stiff the connection assembly needs to be to allow assembly. The connections to the tab 308 provide for the proper displacement of the contacts 310 from each other, as well as providing the proper fit for the prepared coaxial cable.

FIG. 3(*b*) illustrates the connection assembly shown in FIG. 3(*a*) with the prepared coaxial cable 100. The prepared cable is inserted into the connection assembly, where the breakaway tab 308 may be used to facilitate the entry of the prepared cable into the connection assembly. Thereafter, as shown in FIG. 3(*c*), the breakaway tab 308 is separated from the nodes through the thin breakaway connections. The removal of the breakaway tab allows for the nodes 304 and 306 to be electrically isolated and the contacts 310 can then be used to make a connection to the proper circuitry.

Figure 4A:
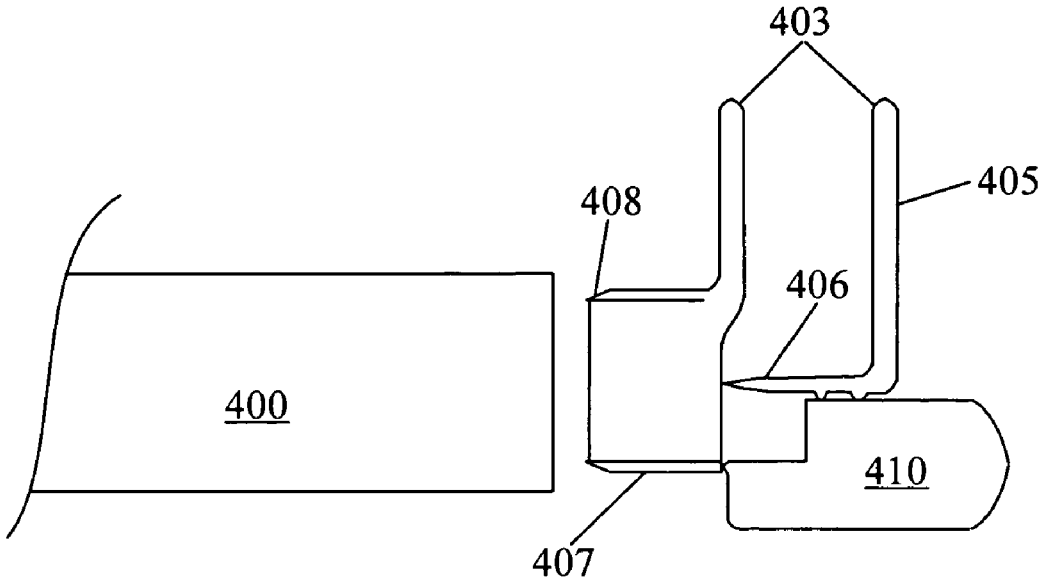
FIG. 4 provides compact connection assemblies, according to other embodiments of the present invention, with FIG. 4(*a*) providing a barrel-connection assembly and FIG. 4(*b*) providing a barbed-connection assembly.
Figure 4B:
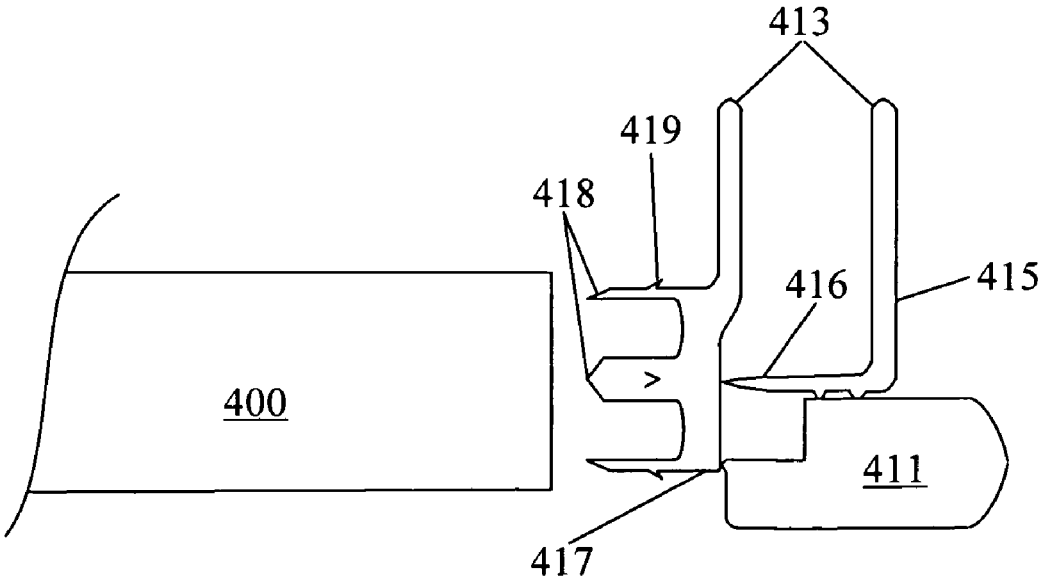

Another embodiment of the present invention is illustrated in FIG. 4(*a*). One key difference between this embodiment and the previously discussed embodiments is that the connection assembly maybe be used to facilitate a connection on an unprepared coaxial cable. This has a benefit in that prior to forming the connection, the cable need only be cut and stripping of the cable is not needed. This is additionally helpful in that the previously discussed embodiments require a degree of stripping of each layer, in order to be accommodated into the connection assembly. While there are many commercially known tools that can facilitate the precise stripping needed, it is still an extra step in the assembly process that can be obviated through the use of connection assemblies that mate with unprepared cables.

The connection assembly illustrated in FIG. 4(*a*) is shown as it would be introduced to the unprepared cable 400. A barrel portion 407 makes contact with the braided conductor of the cable and has a pointed edge 408 that assists in introducing that potion of the assembly into the cable. The barrel portion may achieve the physical connection through direct pressure of barrel portion into the cable end or through direct process with a twisting motion. The connection assembly also has a center portion 405 with a piercing center electrode 406 that is connected to the barrel portion 407 through a breakaway tab 410. Thus, at the same time barrel portion impinges on the braded conductor of the cable, the piercing center electrode makes contact with the centermost conductor of the cable. Each of the barrel portion 407 and the center portion 405 has a contact 403 that engages a hole in the PCB. After the connections of the barrel portion and the piercing center electrode to their respective conductors have been made, the breakaway tab 410 is removed, as discussed with respect to FIG. 3. The cable can then be mounted to the PCB or other circuitry.

Another embodiment of the present invention is illustrated in FIG. 4(*b*), which is a variation on the embodiment illustrated in FIG. 4(*a*). In this embodiment, the barrel portion 417 and the center portion 415 are attached to the breakaway tab 411, and the piercing center electrode 416 and the contacts 413 remain the same as in the prior embodiment. In this embodiment, the barrel portion has pointed sections 418 that aid in introducing the barrel portion to the cable. Also included are barbs 419 on the barrel portion that act to retain the barrel portion in the cable after it has been inserted.

Figure 5A:
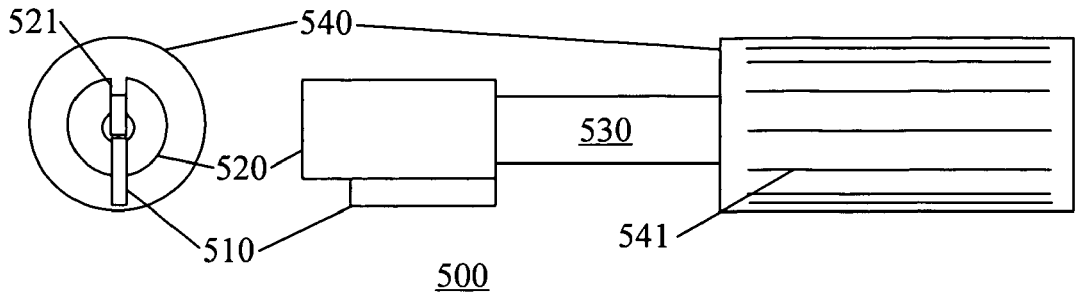
FIG. 5 illustrates a tool for assisting in attaching the connection assembly to a cable, with FIG. 5(*a*) showing the tool and FIG. 5(*b*) showing the tool with a connection assembly inserted therein, according to one embodiment of the present invention.
Figure 5B:
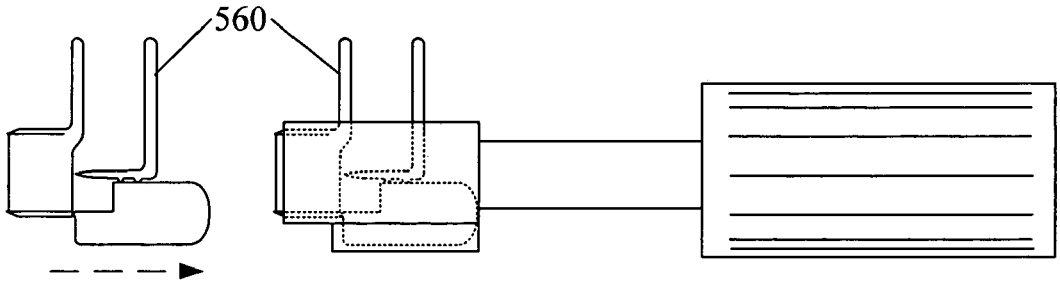

To assist in the formation of the contact, a tool may be used. One such tool is illustrated in FIG. 5, for the connection assembly discussed in the prior embodiment. It is noted that while the tool is illustrated as accommodating the connection assembly illustrated in FIG. 4, other tools having similar characteristics may be used with the connection assemblies of the other embodiments of the present invention. It should also be appreciated that several of the tools discussed below may be coupled together in the production process so that multiple cables may be prepared at the same time through automation.

The tool 500 illustrated in FIG. 5 has a slot portion 510 that receives the breakaway tab and a barrel cavity 520 that receives the central and barrel portions of the connection assembly. A slot 521 in the barrel cavity allows for the contacts of the connection assembly to be slidably received therein. The barrel cavity and slot portion are connected to the handle 450 through an extension 530. The handle 540 may have grip portions 541 to assist the handle in being held and manipulated manually.

FIG. 5(*b*) illustrates the introduction of a connection assembly 560 into the tool 500. As discussed above, the breakaway tab is received in the slot portion and should allow the connection assembly to be received until a portion of the connection assembly sticks out beyond barrel cavity. The jacket of the cable can received between the barrel portion of the connection assembly 560 and the inner diameter of barrel cavity 520 once the barrel portion is forced into the unprepared cable. Subsequently, after being introduced into the cable, the breakaway tab portion is removed to facilitate the isolated electrical connections.

Figure 6:
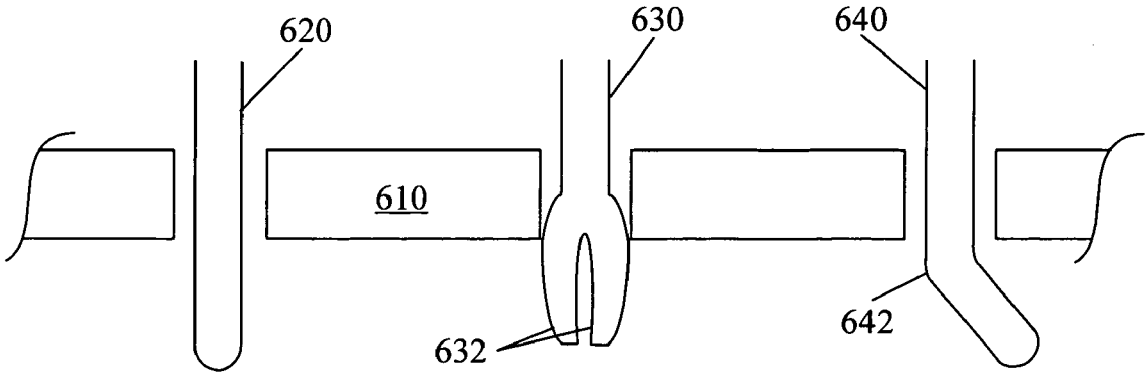
FIG. 6 illustrates different embodiments of the present invention having different electrical contact pins for mounting and retention on a printed circuit board.

In addition, the present invention also seeks to provide retention of the contacts of the connection assembly once the contacts have been threaded through holes in a PCB. FIG. 6 illustrates a cross-section of a PCB 610, showing different types of contacts. The first contact is a straight contact 620 that passes through the PCB. The contact is then soldered or supplied with an electrical connection to the underside of the PCB to the predetermined circuitry. Alternatively, the contact 630 can have a split portion 632. The split portion is formed with a semi-pointed end that allows for the contact to pass through the through-hole in the PCB but resists having the split portion being pulled back through the through-hole. Additionally, the contact 640 may have a bent portion 642, that requires the connection assembly to be tipped or cantilevered with respect to the plane of the PCB to introduce the contact through a hole in the PCB. Thereafter, the connection assembly is rotated and an addition contact is locked into place.

The above-discussed configurations of the present invention have, in preferred embodiments, been discussed with respect to making contacts with circuitry via through-holes in a PCB, but the invention is not so limited. As would be understood by one of ordinary skill in the art, the above discussed connection assemblies and methods would be applicable to surface mount techniques as well. It should also be understood that the present invention is also applicable to use with connections facilitated through wash away spacers or connectors.

It would also be within the scope of the invention to implement the disclosed elements of the invention as a production tool, such that multiple connections to cables may be formed at the same time and multiple connections to the proper circuitry. The production and assembly may also be automated and may be used to increase efficiency of assembly.

The present invention allows for proper connection of a coaxial cable to circuitry. The present invention allows for the concentricity of the coaxial cable connections to be maintained while the cable is affixed to a PCB, thus maintaining electrical characteristics of the connection. The present invention will also speed assembly time by making the antenna wire, formed from the coaxial cable, stay in the PCB during soldering. While the instant invention's connections are not as inexpensive as un-terminated wire, the minor costs are recouped through improved assembly throughput and reduction in errors.

Although the invention has been described based upon these preferred embodiments, it would be apparent to those skilled in the art that certain modifications, variations, and alternative constructions would be apparent, while remaining within the spirit and scope of the invention. In order to determine the metes and bounds of the invention, therefore, reference should be made to the appended claims.

The invention claimed is:

1. A connection assembly for providing an electrical connection from a coaxial cable to planar circuitry comprising:

an innermost connector node, configured to connect electrically to an innermost conductor of a coaxial cable, having one opening that allows for the innermost conductor to pass through the one opening and having a first contact extending perpendicular to a center line of the coaxial cable;

a braided connector node, configured to connect electrically to a braided conductor of the coaxial cable, having two openings that allow for portions of the coaxial cable to pass through the two openings and having a second contact extending perpendicular to the center line of the coaxial cable; and an electrically conductive connection module, removably connected to the innermost connector node and the braided connector node and configured to maintain an orientation of the innermost and braided connector nodes and the first and second contacts;

wherein the first and second contacts can be connected to separate locations of a planar circuitry and provide separate electrical connections to the innermost conductor and the braided conductor of the coaxial cable.

2. A connection assembly as recited in claim 1, wherein the innermost connector node and the braided connector node are configured to make contact with conductors of an un-prepared coaxial cable, where the un-prepared coaxial cable has a cleaved end and the innermost connector node and the braided connector node are inserted into the cleaved end to make the physical and electrical connections.

3. A connection assembly as recited in claim 1, wherein the one opening and at least one of the two openings comprise fluted sections to assist in entry of respective portions of the coaxial cable.

4. A connection assembly as recited in claim 1, wherein the innermost connector node comprises a single spike connected to the first contact, wherein the spike is configured to be inserted into the coaxial cable and make contact with the innermost conductor.

5. A connection assembly as recited in claim 1, wherein the connection module comprises a breakaway tab with small breakaway connections to the innermost connector node and the braided connector node, wherein the breakaway tab is configured to be removed subsequent to connections being made between the coaxial cable and the innermost connector node and the braided connector node.

6. A connection assembly as recited in claim 5, wherein the innermost connector node, the braided connector node and the connection module are formed from a single material and from a single sheet of sheet metal.

7. A connection assembly as recited in claim 1, wherein the planar circuitry comprises a circuitry on a printed circuit board and the first and second contacts are configured to be soldered to sections on the printed circuit board.

8. A connection assembly as recited in claim 7, wherein the circuitry on a printed circuit board provides for wireless networking and the coaxial cable comprises an antenna for wireless networking.

9. A connection assembly as recited in claim 7, wherein at least one of the first and second contacts comprises a retention end that retains the at least one of the first and second contacts after the retention end has passed through a through-hole in the printed circuit board.

10. A connection assembly as recited in claim 1, wherein the braided connector node comprises a barrel connection connected to the second contact, wherein the barrel connection is configured to be inserted into the coaxial cable and make contact with the braided conductor.

11. A connection assembly as recited in claim 10, wherein the barrel connection has a sharpened edge that aids in inserting the barrel connection between an outer jacket and an inner core of the coaxial cable.

12. A connection assembly as recited in claim 10, wherein the barrel connection comprises multiple tines having sharpened edges that aids in inserting the barrel connection between an outer jacket and an inner core of the coaxial cable.

13. A connection assembly as recited in claim 12, wherein the barrel connection further comprises retention barbs that make contact with an inner portion of the outer jacket and aides in retaining the barrel connection after insertion of the barrel connection between the outer jacket and the inner core of the coaxial cable.

14. A connection assembly for providing an electrical connection from a coaxial cable to planar circuitry comprising:

an innermost connector means for connecting electrically to an innermost conductor of a coaxial cable, having one opening that allows for the innermost conductor to pass through the one opening and having a first contact extending perpendicular to a center line of the coaxial cable;

a braided connector means for connecting electrically to a braided conductor of the coaxial cable, having two openings that allow for portions of the coaxial cable to pass through the two openings and having a second contact extending perpendicular to the center line of the coaxial cable; and a releasably secured and electrically conductive connection module means for connecting the innermost connector means and the braided connector means and configured to maintain an orientation of the innermost and braided connector means and the first and second contacts;

wherein the first and second contacts can be connected to separate locations of a planar circuitry and provide separate electrical connections to the innermost conductor and the braided conductor of the coaxial cable.

15. A connection assembly as recited in claim 14, wherein the innermost connector means and the braided connector means are configured to make contact with conductors of a prepared coaxial cable, where the prepared coaxial cable has portions of the coaxial cable stripped away to leave predetermined sections of the innermost conductor and the braided conductor bare.

16. A connection assembly as recited in claim 14, wherein the innermost connector means and the braided connector means are configured to make contact with conductors of an un-prepared coaxial cable, where the un-prepared coaxial cable has a cleaved end and the innermost connector node and the braided connector node are inserted into the cleaved end to make the physical and electrical connections.

17. A connection assembly as recited in claim 14, wherein the one opening and at least one of the two openings comprise fluted sections to assist in entry of respective portions of the coaxial cable.

18. A connection assembly as recited in claim 14, wherein the connection module is formed from a non-conducting material and comprises cavities that are configured to receive the innermost connector means and the braided connector means.

19. A connection assembly as recited in claim 14, wherein the innermost connector means comprises a single spike connected to the first contact, wherein the spike is configured to be inserted into the coaxial cable and make contact with the innermost conductor.

20. A connection assembly as recited in claim 14, wherein the connection module comprises a breakaway tab with small breakaway connections to the innermost connector means and the braided connector means, wherein the breakaway tab is configured to be removed subsequent to connections being made between the coaxial cable and the innermost connector means and the braided connector means.

21. A connection assembly as recited in claim 20, wherein the innermost connector means, the braided connector means and the connection module means are formed from a single material and from a single sheet of sheet metal.

22. A connection assembly as recited in claim 14, wherein the planar circuitry is a circuitry on a printed circuit board and the first and second contacts are configured to be soldered to sections on the printed circuit board.

23. A connection assembly as recited in claim 22, wherein the circuitry on a printed circuit board provides for wireless networking and the coaxial cable comprises an antenna for wireless networking.

24. A connection assembly as recited in claim 22, wherein at least one of the first and second contacts has a retention end that retains the at least one of the first and second contacts after the retention end has passed through a through-hole in the printed circuit board.

25. A connection assembly as recited in claim 14, wherein the braided connector means comprises a barrel connection means for connecting to the second contact, wherein the barrel connection means is configured to be inserted into the coaxial cable and make contact with the braided conductor.

26. A connection assembly as recited in claim 25, wherein the barrel connection means comprises multiple tines having sharpened edges that aids in inserting the barrel connection means between an outer jacket and an inner core of the coaxial cable.

27. A connection assembly as recited in claim 26, wherein the barrel connection means further comprises retention barbs that make contact with an inner portion of the outer jacket and aides in retaining the barrel connection means after insertion of the barrel connection between the outer jacket and the inner core of the coaxial cable.

* * * * *